US005203448A

United States Patent [19]

Osada et al.

[11] Patent Number: 5,203,448

[45] Date of Patent: Apr. 20, 1993

[54] PUSH BUTTON KEY SWITCH

[75] Inventors: Masamitsu Osada, Kawasaki; Nobuyuki Takahashi, Yokohama, both of Japan

[73] Assignee: Minebea Co., Ltd., Nagano, Japan

[21] Appl. No.: 832,929

[22] Filed: Feb. 11, 1992

[30] Foreign Application Priority Data

Feb. 12, 1991 [JP] Japan ..... 3-012080[U]

[51] Int. Cl.[5] ..... H01H 3/12

[52] U.S. Cl. ..... 200/517; 200/341; 200/5 A; 200/342; 200/345

[58] Field of Search ..... 200/517, 520, 341, 345, 200/342, 5 A

[56] References Cited

U.S. PATENT DOCUMENTS

| | | | |
|---|---|---|---|
| 4,454,562 | 6/1984 | Bush . | |
| 4,527,030 | 7/1985 | Oelsch | 200/517 X |
| 4,720,609 | 1/1988 | Hochgesang et al. | 200/5 A |
| 4,755,645 | 7/1988 | Naoki et al. | 200/517 X |
| 4,918,271 | 4/1990 | Deeg | 200/344 |
| 4,927,990 | 5/1990 | Aoki et al. | 200/517 |

FOREIGN PATENT DOCUMENTS

| | | | |
|---|---|---|---|
| 0100936 | 7/1983 | European Pat. Off. . | |
| 0091284 | 10/1983 | European Pat. Off. . | |
| 3414909 | 10/1985 | Fed. Rep. of Germany . | |
| 0057114 | 3/1991 | Japan | 200/341 |
| 0105815 | 5/1991 | Japan | 200/341 |
| 3-108218 | 5/1991 | Japan . | |
| 0108218 | 5/1991 | Japan | 200/341 |
| 0119620 | 5/1991 | Japan | 200/517 |
| 0155013 | 7/1991 | Japan | 200/517 |
| 3-194811 | 8/1991 | Japan . | |

*Primary Examiner*—Ernest G. Cusick
*Attorney, Agent, or Firm*—Staas & Halsey

[57] ABSTRACT

A push button key switch has an intermediate guide cylinder which is free to slide lengthwise inside a fixed guide cylinder and which at the same time holds the neck of a keytop while allowing it to slide freely lengthwise. The intermediate guide cylinder guides the keytop in its motion while the fixed guide cylinder guides the intermediate guide cylinder in its motion. Downward motion of the keytop causes the lower ends of the neck and the intermediate guide cylinder to collapse an elastic member which, in turn, then activates an electrical contact mechanism.

5 Claims, 2 Drawing Sheets

PUSH BUTTON KEY SWITCH

BACKGROUND OF THE INVENTION

1. Field of the Invention

This invention relates to a key switch. More particular, the invention relates to a push button key switch suited for use as a data input key for a computer or word processor.

2. Description of the Prior Art

Many push button type key switches are used in the data input keyboards of computers, word processors and the like. Furthermore, as these electronic devices become more compact, there is increasing demand for the manufacture of thinner, more compact keyboards.

FIG. 3 illustrates a cross-sectional view of a key switch incorporated in a keyboard for a conventional compact electronic device.

In FIG. 3, numeral 1 denotes a keytop, on the upper face of which lettering has been printed or embossed. The keytop 1 is in the form of a cube, the underside of which is open, forming a cavity. A connector 3 is molded so as to protrude down from the middle of the inner cavity of the keytop 1. The connector 3 fits into a cylindrical key stem 5. A concave area 9 is formed inside the bottom end of the key stem 5, and a regulating ledge 7 is formed around its periphery. A frame 11 is disposed about the key stem 5. The frame 11 is molded together with the keyboard base 12 to form a single unit of synthetic resin. The portion formed around the key stem protrudes from the base and in cross-section has the from of a two-step plataform. The key stem 5 is guided on its periphery by a circular opening at the other end of the frame 11 such that the regulating ledge 7 at the bottom end of the key stem is brought into contact with the middle ledge of the frame 11. The concave area 9 of the key stem 5 fits over the head of a cup-shaped rubber spring 14 consisting of an elastic material such as rubber. The underside of the rubber spring 14 is in light contact with a backplate 16, which consists of a steel plate or other like hard, plate-like object. A laminar switch 18, which is in the form of a thin film, is formed on the surface of the backplate 16, i.e., on the portion with which the underside of the rubber spring 14 is in contact. The laminar switch 18 is constructed as follows; two pliable synthetic resin sheets, on the opposing faces of which electric contact points are provided, are placed facing each other with a small space between them in such a manner that the electric contact points are brought into contact as the synthetic resin sheets are pressed together by a protrusion 20 provided on the underside of the rubber spring 14. As such switches are already well known, a detailed explanation shall be omitted.

In the case of a conventional key switch with a construction such as that described, when the key top 1 is pressed down by the finger, the key stem 5, which is attached to the underside of the keytop 1, is guided by the round opening at the top of the frame 11 so that its bottom end depresses the rubber spring 14, causing it to collapse and the protrusion 20 inside it to press down on the laminar switch 18, thereby activating the key switch.

In the case of a key switch of this type, the rubber spring 14, the upper end of which is pressed down by the frame 11, is gradually deformed until it suddenly collapses at the time that a certain deformation threshold is exceeded. The operator experiences the impact at this time as a clicking sensation at the fingertips and gains a sense of how the key switch is operating. Though the more distinct the clicking sensation the better, obtaining such a distinct clicking sensation requires a design which provides a large keystroke distance for the rubber spring 14. This allows the distance through which the protrusion 20 on the rubber spring 14 moves, from its uppermost position to the point at which it activates the laminar switch 18, to be as great as possible. For this reason, the conventional key switch shown in FIG. 3 requires use of a key stem 5 which is long enough to allow use of a rubber spring 14 with a keystroke distance of some length. It is therefore also necessary for the height of the frame 11 which supports the key stem 5 to be correspondingly high.

With the rapid advances of portable computers, word processors and the like in recent years, there has been an attempt to make these devices thinner and more compact which has lead to a demand for thinner keyboards as well. Nevertheless, there is an even stronger demand, contradictory to the above, for use of a keyboard with favorable operating properties in which the long keystroke distance of conventional key switches for keyboards is maintained.

SUMMARY OF THE INVENTION

An object of the present invention is to provide a push button key switch in which the thickness of the key switch is made as thin as possible while maintaining a long keystroke distance for the key.

In order to achieve the aforementioned objective, the present invention provides a push button key switch wherein a contact mechanism is activated by the motion of a keytop pressed a prescribed keystroke distance against the elastic force of an elastic body and deactivated as the elastic force of the elastic body restores the keytop to its original position on removal of pressure from the keytop, characterized in that that the key switch has an intermediate guide cylinder which is free to slide lengthwise inside a fixed guide cylinder and which furthermore holds the neck of the keytop while allowing it to slide freely lengthwise, and in that the intermediate guide cylinder guides the keytop in its motion while the fixed guide cylinder guides the intermediate guide cylinder in its motion.

As the keytop is depressed, its neck descends, guided by the intermediate guide cylinder, until it begins to compress the rubber spring. The keytop next comes in contact with the intermediate guide cylinder and pushes it down until the rubber spring collapses and its activator node impinges upon the electrical contact points. On removal of pressure from the keytop, the keytop, intermediate guide cylinder and rubber spring are restored to their original positions by the elastic force of the rubber spring.

DESCRIPTION OF THE PREFERRED EMBODIMENT

Figure 1:
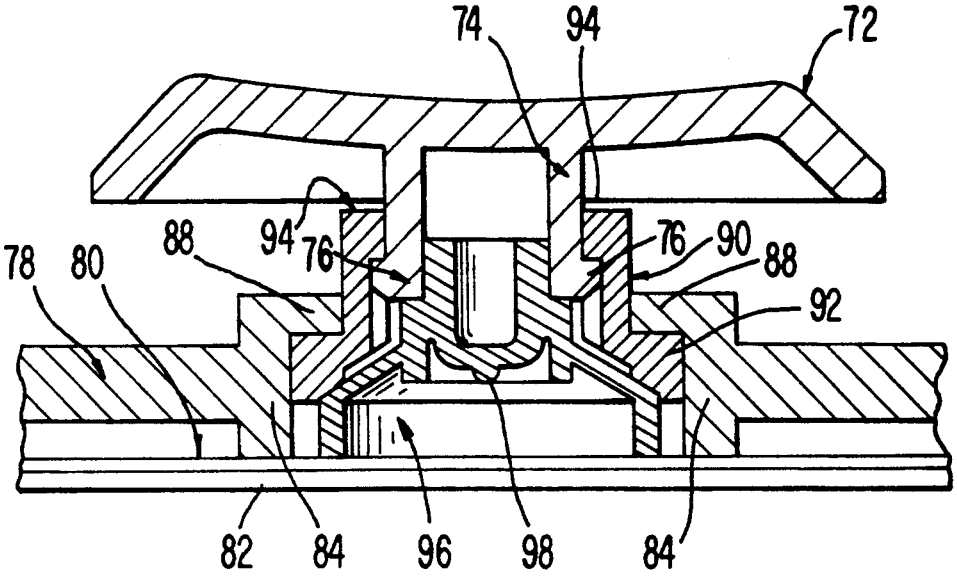
FIG. 1 is a cross-sectional view of an embodiment of a key switch the present invention.

As illustrated in FIG. 1, a push button key switch according to the present invention includes a keytop 72, on the surface of which, are displayed lettering, symbols or numbers by any of various methods. A neck 74, which is in the form of a hollow cylinder, protrudes down from the middle of the underside of the keytop 72. A locking ledge 76 is formed on the periphery of the bottom end of the neck 74. Numeral 78 denotes a base formed on the surface of the keyboard and molded of synthetic resin in a conventional manner. A backplate 82 is positioned a fixed distance below the base 78. A laminar switch 80, which is of conventional type, is made to adhere to the upper surface of the backplate. One part of the base 78 is molded in a cylindrical shape to form a guide cylinder 84. The bottom end of the guide cylinder 84 reaches down as far as the laminar switch 80; obviously, no contact points for the switch are formed in this portion. A stopper 88, which is bent inward, is formed on the upper end of the guide cylinder 84.

Numeral 90 denotes an intermediate guide cylinder. The intermediate guide cylinder 90 has a locking ledge 92 on the periphery of its bottom end, and a locking flange 94 which protrudes inwardly at its upper end. As apparent from FIG. 1, the intermediate guide cylinder 90 is inserted through and free to slide back and forth in a hole formed at the upper end of the guide cylinder 84, and the locking ledge 92, established at its bottom end, is locked into the stopper 88 on the guide cylinder 84. The neck 74 fixed to the underside of the keytop 72 is inserted through the upper end of the intermediate guide cylinder 90 in such a manner that it is free to slide back and forth, and the locking ledge 76 at its bottom end is locked into the locking flange 94 of the intermediate guide cylinder 90. The bottom end of the locking ledge 76 is so tapered that the neck 74 readily fits into the intermediate guide cylinder 90 when the locking ledge 76 is pressed down hard into the intermediate guide cylinder 90 at the time of assembly. The action of the tapered portion, which is capable of deforming slightly due to the resilience of the synthetic resin constituting the keytop 72, makes this possible. Numeral 96 denotes a rubber spring. The upper end of the rubber spring 96 fits into the bottom end of the neck 74, and its underside is placed on the upper surface of the laminar switch 80. Numeral 98 denotes an activator node provided on the rubber spring 96.

As apparent from FIG. 1, the guide cylinder 84, intermediate guide cylinder 90 and neck 74 of the keytop 72 form a spigot joint type structure and behave in the manner of a telescoping fishing rod at the time of extension and contraction.

The operation of the key switch of the present invention is described next.

In the state depicted in FIG. 1, the neck 74 is held up by the elastic force of the rubber spring 96. The locking ledge 76 thus locks into and pushes up the locking flange 94, and with it, the intermediate guide cylinder 90, such that the locking ledge 92 is held in contact with the stopper 88. This state is obviously that in which the key switch is off.

Figure 2:
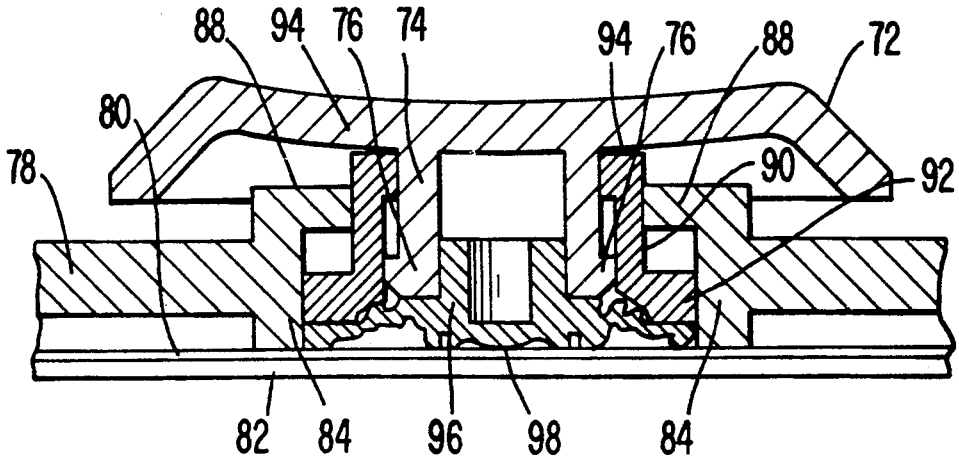
FIG. 2 is a cross-sectional view illustrating the operation of the key switch shown in FIG. 1
Figure 3:
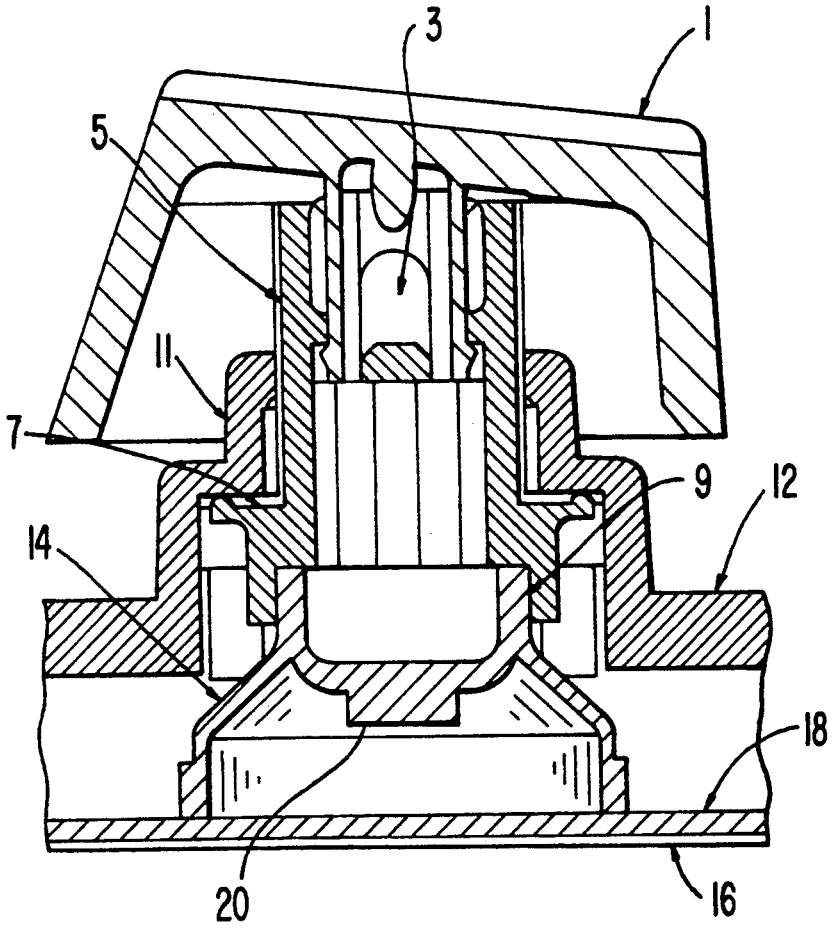
FIG. 3 PRIOR ART
FIG. 3 is a cross-sectional view of a conventional key switch.

The rubber spring 96 begins to be deformed as the keytop 72 is pushed down against the lifting force of the rubber spring 96 from the state shown in FIG. 1. When the underside of the keytop 72 comes in contact with the upper end of the intermediate guide cylinder 90, the keytop 72 begins to push the intermediate guide cylinder 90 as well as the rubber spring 96 downwardly guided by the guide cylinder 84. The bottom of the intermediate guide cylinder 90 also presses down on the side of the rubber spring 96 at this time. The rubber spring 96 suddenly collapses at the point at which the keytop 72 has come down the same keystroke distance as for a conventional key switch, upon which the activator node 98 presses down on the laminar switch 80 and turns it on, as shown in FIG. 2. When the force pushing against the keytop 72 is removed, the restoring force of the rubber spring 96 pushes up the neck 74 so that the locking ledge 76 pulls up the intermediate guide cylinder 90, causing the laminar switch 80 to be turned off and restoring the key switch to the state of FIG. 1. Preferably, the total of the distance of relative motion between the fixed guide cylinder 84 and the intermediate guide cylinder 90 and that between the intermediate guide cylinder 90 and the keytop 72 is greater than the aforementioned prescribed keystroke distance for the keytop 72.

As explained in detail above, in the present invention the guide cylinder, intermediate guide cylinder and neck of the keytop form a spigot joint type structure and behave in the manner of a telescoping fishing rod at the time of extension and contraction in such a manner that there is no need for the use of a long key stem as a guiding part for the keytop as in conventional key switches. For this reason, the present invention exhibits merits such as the fact that the height of the key switch is greatly reduced as compared with that of conventional key switches, and that a clicking sensation the same as that for conventional key switches is nonetheless maintained, due to the fact that an elastic body in the form of a rubber spring of the same height as that of conventional key switches can be used.

We claim:

1. A push button key switch comprising:

a base having a fixed guide cylinder formed therein;

an intermediate guide cylinder slidable lengthwise inside said fixed guide cylinder;

a keytop having a neck extending therefrom, said neck being slidable lengthwise inside said intermediate guide cylinder, said keytop and said neck having a prescribed keystroke distance;

an elastic body positioned below and contacting one end of said neck whereby said elastic body normally biases said keytop and said neck to an uppermost position; and an electric contact mechanism positioned below said elastic body whereby when said keytop is pushed downwardly said prescribed keystroke distance, said one end of said neck and an end of said intermediate guide cylinder contact said elastic body to cause said elastic body to collapse and contact said electric contact mechanism to thereby activate said electric contact mechanism.

2. The push button key switch according to claim 1, wherein the total of the distance of relative motion between said fixed guide cylinder and said intermediate guide cylinder and that between said intermediate guide cylinder and said keytop is greater than said prescribed keystroke distance for the keytop.

3. The push button key switch according to claim 1, wherein said elastic body is a cup-shaped rubber spring.

4. The push button key switch according to claim 3, wherein said rubber spring includes an activator node which contacts and activates the contact mechanism when said rubber spring is in a collapsed position.

5. The push button key switch according to claim 3, wherein said electric contact mechanism remains activated while said rubber switch is in a collapsed position and becomes deactivated when said rubber switch returns to its normal position.

* * * * *

UNITED STATES PATENT AND TRADEMARK OFFICE
CERTIFICATE OF CORRECTION

PATENT NO. : 5,203,448

DATED : April 20, 1993

INVENTOR(S) : MASAMITSU OSADA and NOBUYUKI TAKAHASHI

It is certified that error appears in the above-identified patent and that said Letters Patent is hereby corrected as shown below:

Column 1, line 32, "from" should be --form--;

line 32, "plataform" should be --platform--;

line 34, "other" should be --upper--.

Column 2, line 41, delete --that-- (second occurrence);

line 64, after "switch" insert --of--;

line 66, after "FIG. 1" insert a period --.--.

Signed and Sealed this

Eighteenth Day of January, 1994

*Attest:*

Bruce Lehman

BRUCE LEHMAN

*Attesting Officer*

*Commissioner of Patents and Trademarks*